United States Patent [19]

Tanaka et al.

[11] Patent Number: 4,547,146

[45] Date of Patent: Oct. 15, 1985

[54] IGNITION DEVICE FOR SINTERING MACHINE

[75] Inventors: Kunihiro Tanaka; Nobuhiro Futagami, both of Chiba, Japan

[73] Assignee: Kawasaki Steel Corp., Tokyo, Japan

[21] Appl. No.: 600,580

[22] Filed: Apr. 16, 1984

[30] Foreign Application Priority Data

Apr. 28, 1983 [JP] Japan ..... 58-73849

[51] Int. Cl.[4] ..... F23C 5/08

[52] U.S. Cl. ..... 431/180; 432/196; 266/178; 239/426; 239/549; 239/556

[58] Field of Search ..... 239/426, 433, 434, 549, 239/556, 557, 566; 431/180, 186, 189; 432/133, 136, 146, 196, 137; 266/178

[56] References Cited

U.S. PATENT DOCUMENTS 2,840,149 6/1958 Arnold ..... 239/557

*Primary Examiner*—Carroll B. Dority, Jr.

*Attorney, Agent, or Firm*—Bierman, Peroff & Muserlian

[57] ABSTRACT

This improved ignition device for a moving grate type sintering machine is an inexpensive, compact combustion device which can form a strip of flame extending uniformly and continuously over the width of the strand. This ignition device can provide a uniform ignition intensity, and the ignition conditions of the raw mix can be controlled optimally by moving the burner and a hood therefor vertically and/or rotatably in accordance with the operational conditions of the sintering process. The ignition device thus contributes to prevent the sintered ore from being unevenly sintered, and to save heating energy.

2 Claims, 10 Drawing Figures

IGNITION DEVICE FOR SINTERING MACHINE

BACKGROUND OF THE INVENTION

1. Technical Field

This invention proposes an ignition device for a sintering machine, and more particularly an ignition device for a moving grate type sintering machine which employs a burner capable of forming a strip of flame extending continuously over the width of the strand to enable easy control of igniting the raw mix in accordance with operational conditions, and also enable large savings in fuel.

2. Description of the Prior Art

In general, an ignition device for a moving grate type sintering machine employs burners which are positioned over the surface of the raw mix placed on pallets, and which are adapted to burn a fuel such as heavy oil, coke oven gas, or mixed gas consisting of coke oven gas and blast furnace gas, whereby the coke in the raw mix is burnt by the combustion flames of the fuel.

FIG. 1 schematically illustrates a sintering machine in which the ignition device is installed. Referring to the drawing, reference numeral 1 denotes pallets, 2 wind boxes, 3 an ignition device consisting mainly of an ignition furnace 3*a* and burners 3*b*, 4 a hearth layer hopper, and 5 a raw mix hopper.

FIG. 2 illustrates a typical, conventional ignition device for a sintering machine which consists of a burner assembly 3*b* provided with a plurality of burner arrays arranged in the direction of the pallets movement, each of the burner arrays being composed of a number of burners.

In such a conventional ignition device, uneven sintering occurs in the sinter products, and the fuel consumption becomes higher.

FIG. 3 shows the ignition intensity obtained over the width of the strand, when a conventional ignition device is used. As is clear from the figure, the ignition intensity varies in very different values according to the positions immediately under the burners or else. This causes uneven sintering of the sinter ore. In such a case, it was usually necessary to adjust the combustion rate of the burner assembly 3*b* on the basis of the weakest portion of the transversal ignition intensity so as to prevent the sintered ore from being unevenly sintered. This results in an increase of the energy consumption. Moreover, since each burner has different thermal characteristics, it is very difficult to obtain a uniform ignition intensity over the width of the strand.

Such a conventional ignition furnace 3*a* has such a vertical dimension as high as 1500 mm on average, so that the is a long distance between the burner tips and the surface of the raw mix. This tends to increase energy losses.

An ignition device provided with a single mixing combustion chamber which has a slit-shaped combustion gas discharge port has been proposed in Japanese Patent Laid-open No. 37685/1982. In this ignition device, not a flame but a kind of high-temperature waste gas is blown out of the slit-shaped discharge port. Accordingly, the ignition device has the following disadvantages.

Since the mixing combustion chamber becomes red-heated, the slit-shaped burner tip forming the combustion gas discharge port is liable to deform. Consequently, the burner tip has to be made of special materials, and the structure thereof is inevitably complicated.

It is difficult to burn a fuel completely in this mixing chamber, and energy losses cannot be prevented because of the large capacity of the ignition furnace. Moreover, an elaborately-constructed, sufficiently-supported furnace body is necessary, so that the cost is higher.

SUMMARY OF THE INVENTION

An object of the present invention is to provide an ignition device which can prevent the occurrence of uneven sintering in the products on the sintering machine, and which can save ignition energy.

Another object of the present invention is to provide a compact, inexpensive and maintenance-free ignition device.

Still another object of the present invention is to provide an ignition device in which the ignition conditions can be controlled in accordance with operational conditions of the sintering process, and which has a high efficiency for ignition.

According to the present invention, an ignition device is provided with a burner body which has a horisontal gas passage extending across the width of the strand, and air passages attached to the both sides of the gas passage; and an elongated burner tip which is attached removably to the burner body. The burner tip is provided with a great number of gas outlet holes and air outlet holes arranged in a plurality of rows in the lengthwise direction thereof, in such a manner that the directions in which gas and air are ejected from the gas and air outlet holes cross each other. Accordingly, a strip of flame extending uniformly and continuously over the width of the strand can be formed. Therefore, the present invention contributes to the prevention of uneven sintering of the sinter products and a saving of energy.

This ignition device is supported on a girder which is vertically movable and/or laterally rotatable, and is provided with a small burner hood which can move vertically and/or rotatably with the burner body. Therefore, an optimum flame can be formed in accordance with the operational conditions of the sintering machine, and the ignition conditions can be controlled easily, so that the fuel required is reduced.

The above and other objects, as well as novel characteristics, of the invention will become completely clear from the following description of an embodiment and the accompanying drawings. The drawings have been prepared only to describe the invention, and should not be taken as limiting the scope thereof.

DETAILED DESCRIPTION OF THE INVENTION

Figure 1:
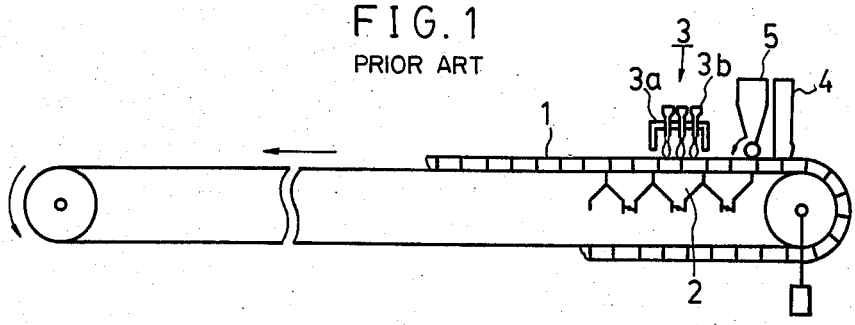
FIG. 1 PRIOR ART
FIG. 1 is a schematic diagram of a sintering machine.
Figure 2:
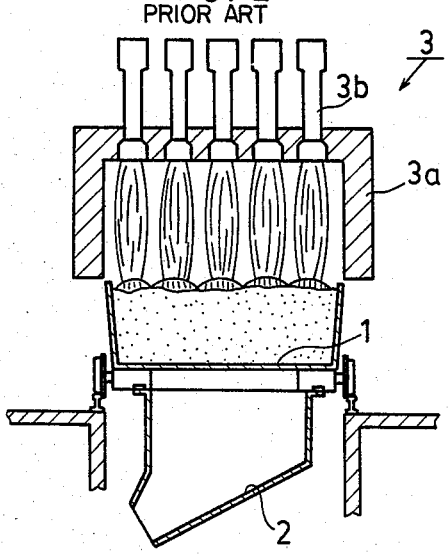
FIG. 2 PRIOR ART
FIG. 2 is a sectional view of a conventional ignition device.
Figure 3:
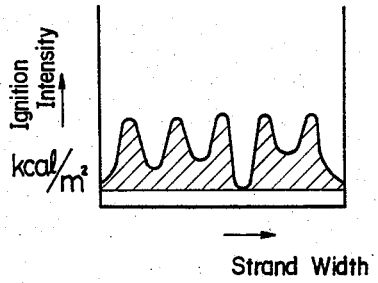
FIG. 3 PRIOR ART
FIG. 3 is a graph of the ignition intensity in the lateral direction of the strand, which is obtained by the conventional ignition device.
Figure 4:
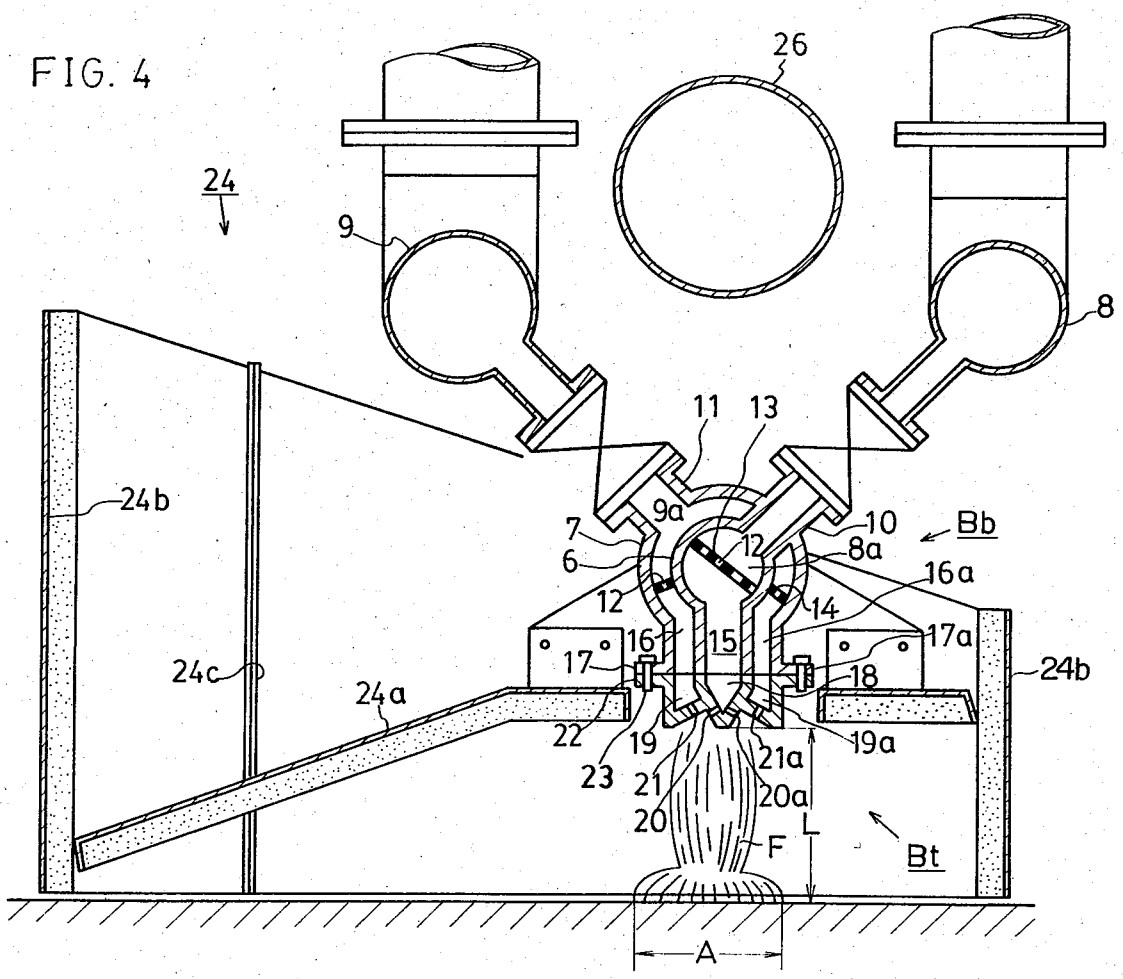
FIG. 4 is a sectional view of the ignition device according to the present invention.

FIG. 4 onward show a preferred embodiment of an ignition device according to the present invention. Referring to the drawings, reference numeral 6 denotes a fuel gas tube, 7*a* combustion air tube, 8*a* fuel gas supply pipe, and 9 an air supply pipe. The tubes 6, 7, and the pipes 8, 9 extend across the width of the strand. The gas tube 6 and the gas supply pipe 8, and the combustion air tube 7 and the air supply pipe 9, communicate with each other separately at a plurality of axially distributed portions thereof through a plurality of short tubes 10, 11 respectively. The fuel gas tube 6 and the air tube 7 are arranged to form a concentric double tube. Coke oven gas or the like flows inside of the fuel gas tube 6 which defines a central flow passage 8*a*, and air flows inside of the air tube 7 which defines an annular flow passage 9*a*.

The interiors of the central flow passage 8*a* for the fuel gas and the annular flow passage 9*a* for the air are provided with detachable distributing plates 13, 14 respectively, each having a great number of through holes 12, the plates 13, 14 acting as means for distributing gas and air uniformly along the axial direction of the tubes 6, 7.

A narrow burner passage 15 for fuel gas and burner passages 16, 16*a* for air, all the passages 15, 16, 16*a* extending across the width of the strand, radially project from the fuel gas tube 6 and the combustion air tube 7, respectively. The combustion air tube 7 has flanges 17, 17*a* for connection. A burner body Bb is formed in the above manner.

A burner tip Bt is secured to the flanges 17, 17*a* of the burner body. The burner tip Bt is provided with a gas passage 18 and air passages 19, 19*a* corresponding to the burner passage 15 and burner passages 16, 16*a* respectively. Outlet holes 20, 20*a*; 21, 21*a* open at the lower part of the passage 18 and passages 19, 19*a*, respectively. Flanges 22, 22*a* are provided at the upper side of the burner tip, and the burner tip is attached removably to the burner body Bb with bolts 23.

Figure 5:
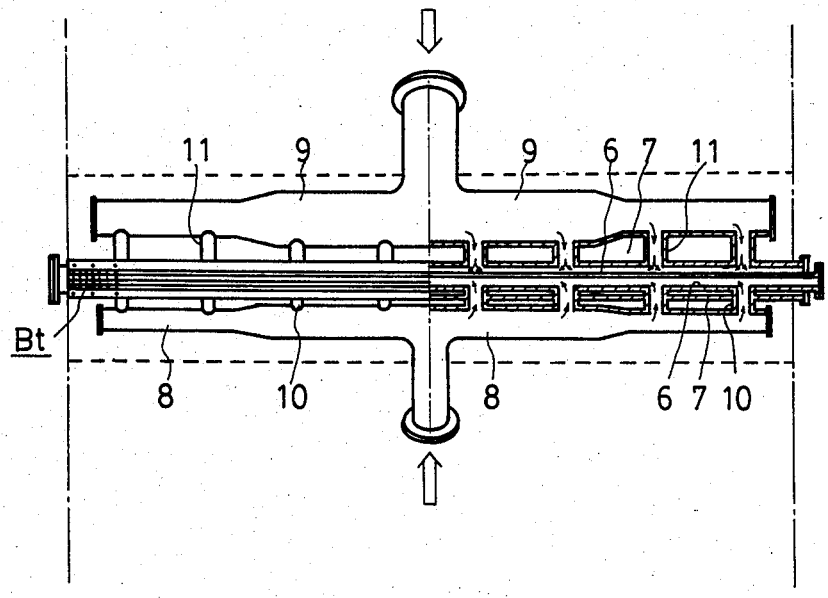
FIG. 5 is a bottom view, partially sectioned, of the ignition device according to the present invention.
Figure 6:
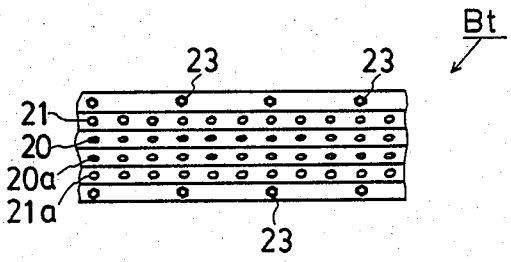
FIG. 6 is an enlarged bottom view of an outlet hole portion of the burner tip.
Figure 7:
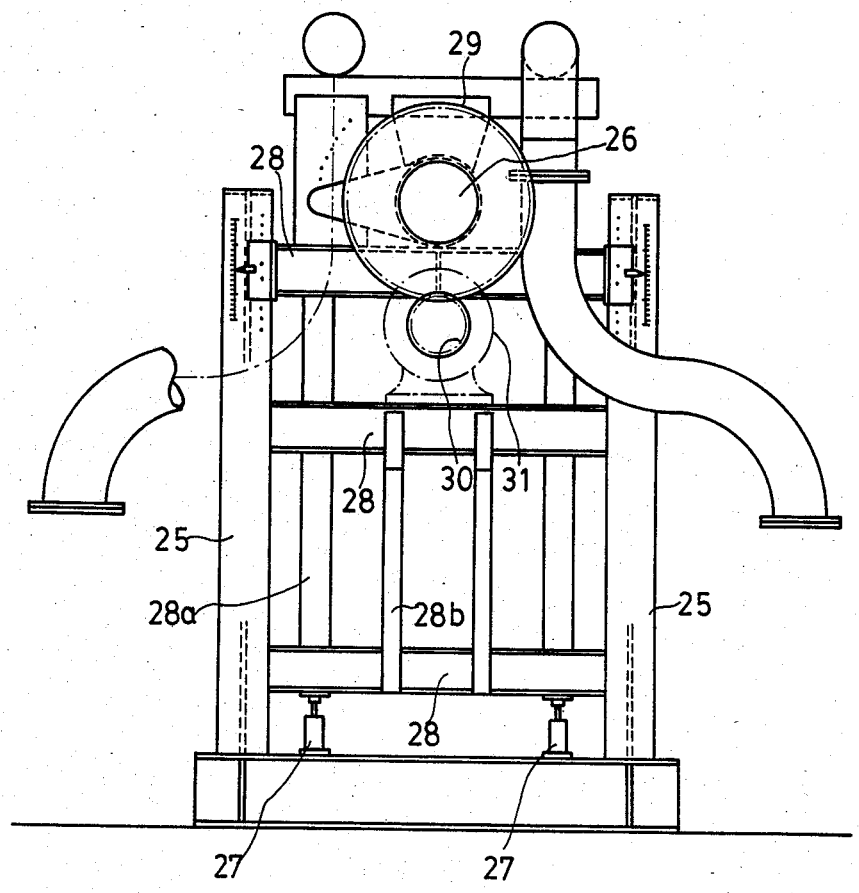
FIG. 7 is a side elevation of the ignition device according to the present invention.
Figure 8:
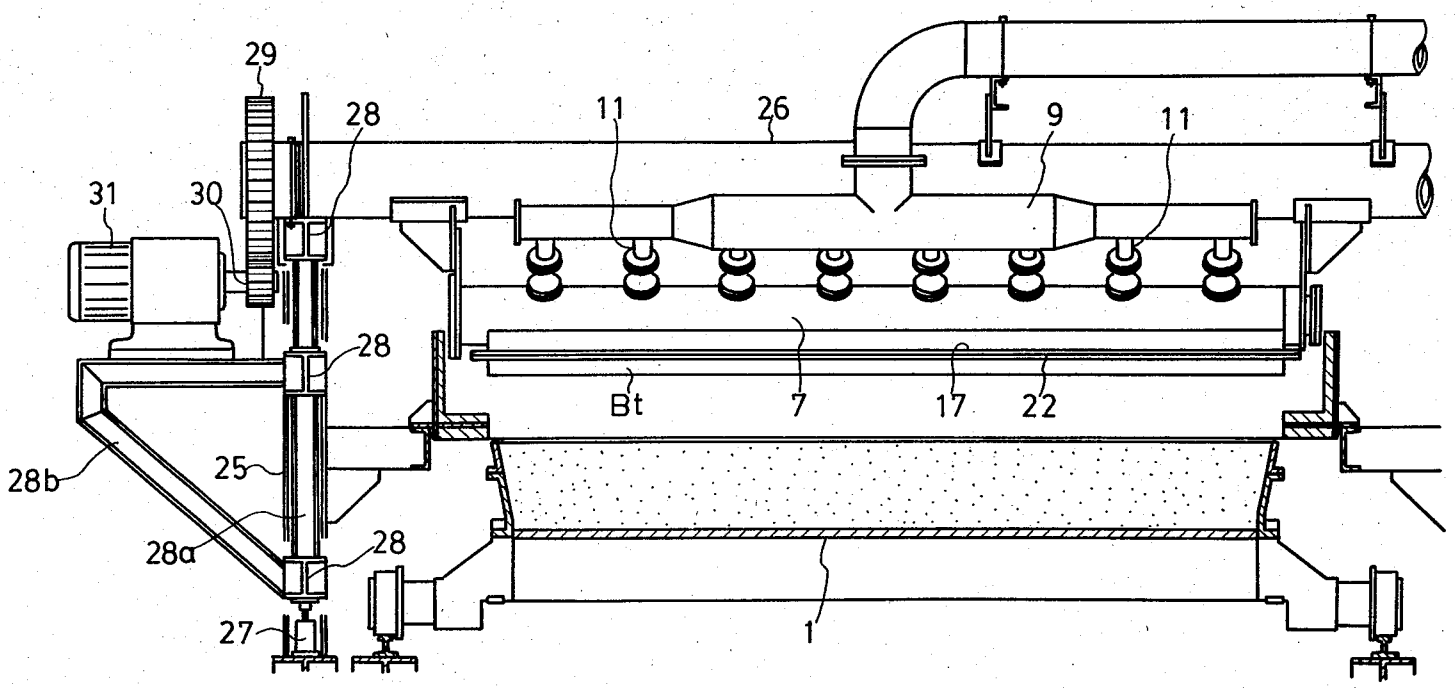
FIG. 8 is a front elevation of a pallet of the sintering machine and the ignition device.

The outlet holes 20, 20*a* for fuel gas in the burner tip Bt open so as to point outward, and the outlet holes 21, 21*a* for air open so as to point in the opposite direction, i.e. inward. In other words, these holes 20, 20*a*; 21, 21*a* are formed in such a manner that fuel and air are ejected therefrom so as to cross each other. As shown in FIGS. 5 and 6, a great number of combinations of outlet holes 20, 20*a*; 21, 21*a* are arranged at intervals of about 10–20 mm in the axial direction of the tubes 6, 7, i.e. across the width of the strand. Accordingly, the flame formed by this ignition device extends in a strip of a uniform cross-sectional shape over the width of the strand.

It is also effective to design the outlet holes 20, 20*a*; 21, 21*a* in such a manner that holes in different positions across the width of the strand have different diameters. This means that the flame can have a more uniform shape and intensity.

The burner body Bb, the fuel gas tube 6 and combustion air tube 7, which are located parallel with the girder 26, are supported by the girder 26 which is arranged so as to extend across the width of the strand, set up in reasonable positions on the sides of the pallets 1.

The girder 26 is so formed that it can be moved vertically and/or rotatably, as shown in FIGS. 4, 7, 8 and 9. As a result, the burner body Bb can be moved vertically and/or rotatably. Accordingly, the height L of the burner tip Bt can be adjusted in accordance with the length of a flame F from the burners, and the scope A in which the flame F comes into contact with the surface of the raw mix on the pallets can also be adjusted as appropriate.

Figure 9:
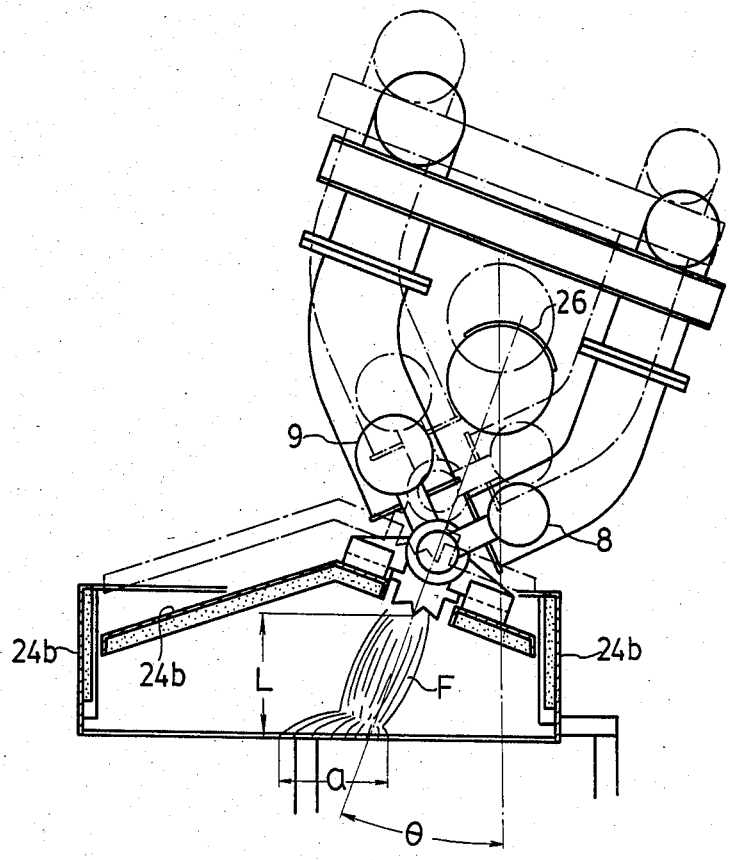
FIG. 9 is a schematic diagram showing how the burner body moves in the vertical direction.

The girder 26 is moved vertically by moving a lift saddle 28 to any position, as shown in FIG. 9, using lift cylinders 27 provided on the stands 25. The girder 26 is rotated by operating back and forth a motor 31 which is set on the lift saddle 28, with a pinion 30 and a gear 29. The gear 29 is fixed to one end of the girder 26 and engaged with the pinion 30. The girder 26 is rotated in this manner so as to incline the burner body Bb at an appropriate angle $\theta$. In order to support the girder 26 movably, both the gas supply pipe 8 and the air supply pipe 9 are provided partially with flexible tubes.

According to the present invention described above, the outlet holes 20, 20*a*; 21, 21*a* in the burner are arranged and combined in such a manner that the directions in which fuel gas and combustion air are ejected cross each other. Therefore, the length of the flame formed by the present invention is smaller than that of a flame formed in a conventional ignition device of this kind. This enables a reduction of the distance between the surface of the raw mix on the pallets and the lower part of the burner tip Bt. The burner hood in the present invention can be constructed as follows.

The overall dimensions, not only the height, of the burner hood 24 can be reduced, so that the ignition device can be made more compact. This enables a minimization of energy losses and construction cost. The burner hood shown in FIG. 4 is a preferred example thereof which consists of a combination of an upper hood 24*a* attached so as to enclose only the combustion atmosphere below the burner tip Bt, and side walls 24*b* set up so as to surround the peripheral edge of the upper hood 24*a*.

The hood 24 is divided into the upper hood 24*a* and the side walls 24*b* to allow for the rotational movement of the burner body Bb. The heights of the side walls 24*b* are determined by the ranges of the vertical and/or rotational movements of the burner body Bb. Reference numeral 24*c* denotes a clearance-regulating fish plate used for bringing the edges of the side walls 24*b* and the upper hood 24*a* into close contact with each other to enable the burner body Bb to rotate smoothly. In this way, the ignition hood 24 can be made much smaller than that of a conventional ignition furnace. The construction of the burner hood 24 is not limited to this structure; any other suitable burner hood, such as an burner hood provided with hanging shields at the edges of the upper hood 24*a* may be used, provided that it can enclose the combustion atmosphere.

The compaction of the ignition hood 24 and the employment of the detachable burner tip Bt have the following co-operative effects. When the burner tip Bt of the present invention is employed, a flame can be formed which extends uniformly over the width of the strand, and which enables a saving in heat energy for ignition. Accordingly, the hood 24 need only be formed so as to cover the burner tip Bt alone. However, in this arrangement, the burner tip Bt is liable to heat up and be thermally deformed as is often the case with a conventional burner. In order to eliminate this disadvantage, the burner tip Bt is preferably formed so that it can be replaced easily. In order to do this, the burner tip of the present invention is made detachable from the burner body.

As stated above, the flame from the burner of the present invention is formed in the shape of a strip of short flame extending uniformly over the width of the strand. Accordingly, a uniform transversal ignition intensity can be obtained, and the hood can be made compact. This enables a large decrease in energy losses.

For example, the results of experiments conducted by the inventors under conditions of sintered ore production rate of 5000 t/D, a fuel gas supply rate of 3.5 Nm3/t, an air-fuel ratio of 2.2, a calorific value of mixed gas of 2300 kcal/Nm3, the height L of the lower edge of the burner tip of 400 mm, and an inclination angle $\theta$ of the burner of 20 degrees show that the fuel consumption can be reduced to 8000 kcal/t.sinter, compared with that, 15,000 kcal/t.sinter, obtained by using a conventional ignition device under the same conditions.

According to the present invention, the burner tip can be replaced simply, so that the lifetime of the ignition device can be prolonged.

Since the ignition device as a whole can be made more compact, and since parts can easily be replaced, construction cost and maintenance expenses can be reduced.

Figure 10:
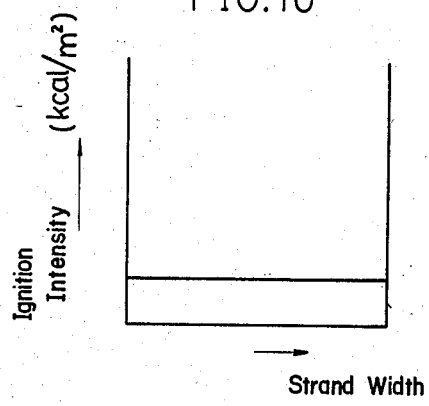
FIG. 10 is a graph of the ignition intensity across the width of the strand obtained by the ignition device according to the present invention.

Furthermore, a uniform transversal ignition intensity (see FIG. 10) can be obtained. This enables a prevention of the occurrence of uneven sintering in the sintered ore, and a large improvement in the yield of the sintered products.

In addition, the burner body of the present invention is so designed that it can be moved vertically and/or rotatably in accordance with sintering conditions.

Therefore, the present invention can be used effectively to secure preferable operational conditions and obtain sintered ore of an excellent quality.

The above is a description of a preferred embodiment of the present invention. It may be clearly understood that various modifications within the scope and the spirit of the present invention can be made by those skilled in the art. The scope of the present invention is limited only by the following claims.

We claim:

1. An ignition device for a moving grate type sintering machine comprising; a fuel gas supply pipe 8 and a combustion air supply pipe 9; a downwardly-faced burner body Bb connected to said supply pipes 8,9 and provided with a gas passage 15 in a central portion thereof and air passage 16, 16*a* on either side gas passage 15; an elongated burner tip Bt attached removably to said burner body Bb and provided with a gas passage 18 in a central portion thereof and air passages 19, 19*a* on either side of said gas passage 18, said passages 18,19,19*a* facing said passages 15,16,16*a* respectively, in said burner body Bb; an ignition hood attached to said burner body Bb enclosing the ignition atmosphere below the burner tip Bt; and a plurality of combinations of downwardly opened burner nozzle holes 20, 20*a* for fuel gas and 21, 21*a* for combustion air provided along said burner tip, each combination including in a common plane a pair of downwardly and oppositely directed fuel gas holes having a central axis and a pair of air holes downwardly and inwardly directed toward each other and each having an axis intersecting an axis of a fuel gas hole, the combinations being arranged in a row across the width of the burner body.

2. The ignition device for a moving grate type; sintering machine according to claim 1, wherein said ignition device further comprises; means to move said burner body vertically; and/or means to incline the direction of burner flame toward the upper face of raw mix in the sintering machine.

* * * * *